US011596186B2

(12) United States Patent
Giorgini

(10) Patent No.: US 11,596,186 B2
(45) Date of Patent: Mar. 7, 2023

(54) GARMENT STRUCTURE

(71) Applicant: Treré Innovation, S.r.l., Asola (IT)

(72) Inventor: Fabio Giorgini, Monticelli Brusati (IT)

(73) Assignee: TRERE' INNOVATION S.R.L., Asola (IT)

( * ) Notice: Subject to any disclaimer, the term of this patent is extended or adjusted under 35 U.S.C. 154(b) by 0 days.

(21) Appl. No.: 16/962,395

(22) PCT Filed: Jan. 16, 2019

(86) PCT No.: PCT/IT2019/000001
§ 371 (c)(1),
(2) Date: Jul. 15, 2020

(87) PCT Pub. No.: WO2019/142216
PCT Pub. Date: Jul. 25, 2019

(65) Prior Publication Data

US 2021/0059321 A1 Mar. 4, 2021

(30) Foreign Application Priority Data

Jan. 17, 2018 (IT) ..... 102018000001151

(51) Int. Cl.
*A41D 1/04* (2006.01)
*A41D 13/00* (2006.01)
(Continued)

(52) U.S. Cl.
CPC ..... *A41D 1/04* (2013.01); *A41D 13/0015* (2013.01); *A41D 27/10* (2013.01); *A41D 31/18* (2019.02);
(Continued)

(58) Field of Classification Search
CPC ..... A41D 1/04; A41D 27/10; A41D 2400/38; A41D 2600/10; A41D 15/007; A41B 1/00;
(Continued)

(56) References Cited

U.S. PATENT DOCUMENTS 2,035,377 A * 3/1936 Redmond ..... A41B 9/06 2/111
3,195,147 A * 7/1965 Kohei ..... A41D 1/04 2/115
3,675,246 A * 7/1972 Ito ..... A41D 1/00 2/115
4,570,267 A * 2/1986 Appel ..... A41B 9/06 2/91
(Continued)

FOREIGN PATENT DOCUMENTS

GB 2527629 12/2015
WO 2017/118902 7/2017

OTHER PUBLICATIONS

International Search Report dated May 10, 2019 in International (PCT) Application No. PCT/IT2019/00001.

*Primary Examiner* — Jameson D Collier
*Assistant Examiner* — Matthew R Marchewka
(74) *Attorney, Agent, or Firm* — Wenderoth, Lind & Ponack, L.L.P.

(57) ABSTRACT

A garment structure for making a base layer or midlayer jersey for sporting activities that includes a first tubular element that corresponds to both the front and the rear zone of the torso and a second tubular element that affects arms, shoulders and part of the torso in which both the first element and the second are obtained with circular machines making a knitted fabric that provides different processing that enable functional and structural features to be given to the knitted fabric and to the garment. In particular, the first tubular element has a cylindrical conformation with a lower edge that bounds the length of the jersey and an upper end divided into a pair of profiles: a first profile defined, laterally,
(Continued)

by the line of the sides and a second profile that leads away from the line of the sides continuing the first profile with a trapezium configuration.

11 Claims, 3 Drawing Sheets

(51) Int. Cl.
*A41D 31/18* (2019.01)
*A41D 27/10* (2006.01)

(52) U.S. Cl.
CPC ..... *A41D 2400/38* (2013.01); *A41D 2500/10* (2013.01); *A41D 2600/10* (2013.01)

(58) Field of Classification Search
CPC .. A41B 1/12; A41B 1/18; A41B 3/005; A41B 9/06; A41B 2300/35; A41B 2400/38
USPC ..... 2/69, 77, 115, 125
See application file for complete search history.

(56) References Cited

U.S. PATENT DOCUMENTS

| | | | | |
|---|---|---|---|---|
| 6,550,287 | B1 * | 4/2003 | Sherrill | A41D 1/04 2/113 |
| 7,028,342 | B1 * | 4/2006 | Nordstrom | A41D 1/04 2/119 |
| 10,925,338 | B2 * | 2/2021 | Turner | A41D 1/08 |
| 2004/0016041 | A1 * | 1/2004 | Uno | A41B 9/06 2/113 |
| 2006/0048263 | A1 * | 3/2006 | Walsh | A41D 31/12 2/69 |
| 2014/0059735 | A1 * | 3/2014 | Taylor | A41B 1/08 2/69 |
| 2015/0237921 | A1 * | 8/2015 | Uttich | A41B 9/06 2/69 |
| 2016/0050994 | A1 * | 2/2016 | Bushby | A41B 9/06 2/243.1 |
| 2016/0235126 | A1 * | 8/2016 | Roscoe | A41D 1/04 |
| 2017/0035122 | A1 * | 2/2017 | Farron | A41D 3/02 |
| 2017/0071275 | A1 * | 3/2017 | Darby | A41D 31/14 |
| 2020/0214364 | A1 * | 7/2020 | Tran | A41B 9/06 |

* cited by examiner

FIG.5A
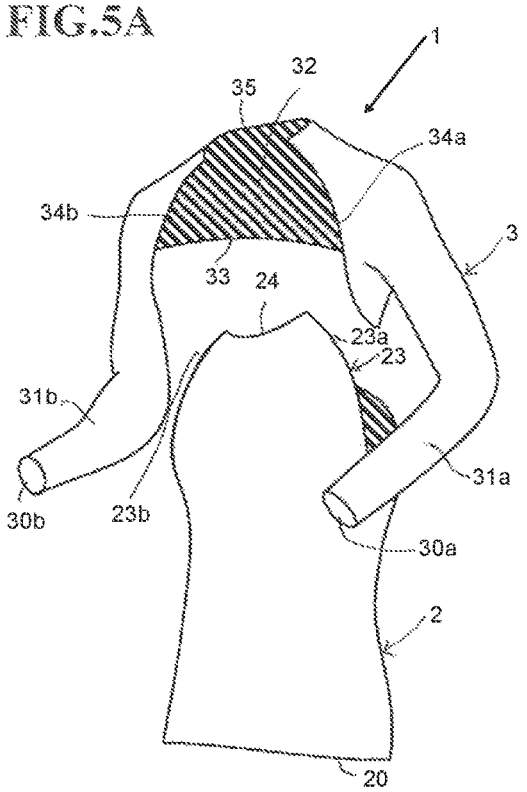
FIG.5B
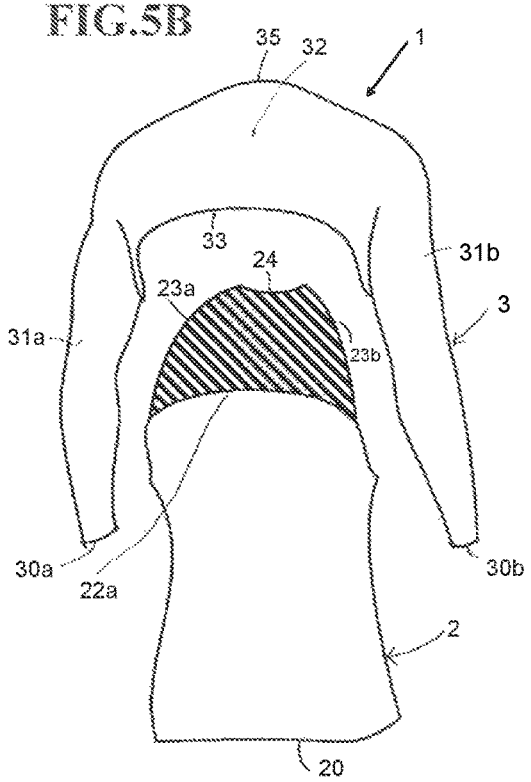
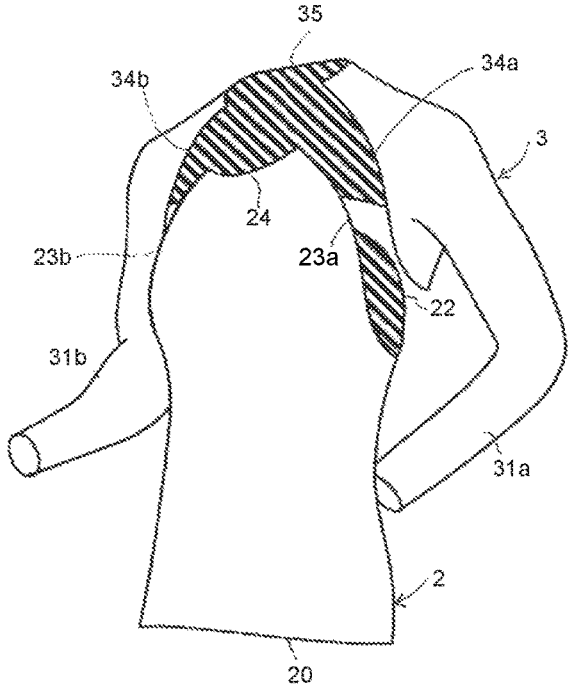
FIG.6A
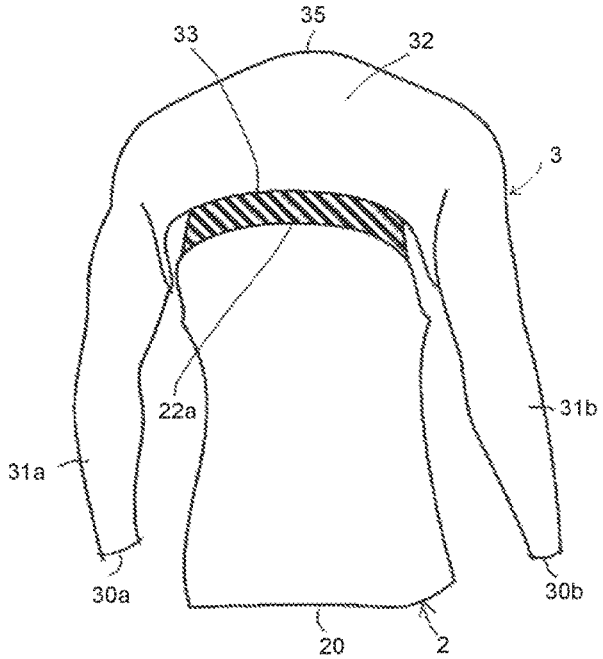
FIG.6B

GARMENT STRUCTURE

TECHNICAL FIELD

The present invention relates to a garment structure that is particularly suitable for making jerseys that permit unlimited freedom of movement without restrictions or constrictions.

BACKGROUND ART

Today, the need to have garments with increasingly specialist performance has led research to develop manufacturing processes and methods that are increasingly high-performance and focused in order to be able to respond to the highly specific needs for versatility, comfort and freedom of movement. As is known, for sports activities and not only for sports activities, users require clothing that is able to meet well defined requirements; in fact, the garment must be easy to wear and must offer increasingly greater freedom and naturalness of movement and must not make the user feel restricted or constrained. Further, a garment must provide an excellent sensation of wellbeing when it is worn, in addition to having a pleasing, attractive and particular appearance.

Both base layer and midlayer underwear should be largely devoid of stitching, must be soft and smooth, adapt perfectly to the body like a second skin, but above all make itself invisible under the outer clothing and stitching is noticed because it is raised and is uncomfortable because it is stiffer and thicker than the rest of the fabric.

Currently, garments are made that have elastic or elasticized yarns in the weave that make the garment very flexible and extendible and the presence of stitching that joins the different parts of the garment creates zones that are less elastic, less soft and unpleasant in contact with the skin and are hardly extendible so that they constrain and limit the movements of the user.

As is known, stitching is no longer aesthetically acceptable in underwear and in sportswear, precisely because these garments are very close-fitting and are in contact with the skin and stitching causes discomfort, irritations and aesthetic blemishes, so that the emphasis is on making garments that have the smallest amount of stitching, both to improve wearability for the user and to reduce tension zones that are uncomfortable.

In addition, another aspect to consider arises from the fact that reducing stitching implies smaller garment finishing costs because reducing the processing steps considerably affects production costs apart from the smaller amount of machines with consequent lower energy costs. Another aspect of the reduction of the stitching in garments enables production to be ready immediately, with faster sampling.

As mentioned previously, users of both base layer and midlayer underwear strongly feel the need for garments that have optimum adhesion to the body and lightness, features that ensure great comfort, that are functional and ensure both professional and amateur users the greatest margins of movement and wellbeing.

In addition to what has been illustrated so far, one need that the market has made felt is that of being able to have available underwear for different sporting disciplines that are increasingly ergonomic, allowing the user to perform a series of even extreme movements in the most total comfort without any sense of constriction or limitation or weight, promoting—at the same time—perfect transpiration and heat regulation, good protection of the parts of the body with which the garment comes into contact, but also garments with a pleasing and attractive aesthetic appearance and which are above all light, soft and are certainly not bulky and voluminous.

SUMMARY OF INVENTION

The object of the present invention is substantially to solve the problems of the prior art by overcoming the drawbacks described above by a garment structure that offers a user the greatest freedom of movement without any sensation of constriction or limitation and has optimum comfort when worn.

A second object of the present invention is to make a garment structure that gives the garment structural features that are translated into functional features in order to be able to eliminate the discomfort and limitations imposed by the stitching on the movement of arms and shoulders.

A third object of the present invention is to make a garment structure that enables a seamless graphic design and/or processing to be obtained on the entire zone of the shoulders and sleeves.

A further object of the present invention is to make a garment structure that gives the possibility of being able to manage and calibrate a support for the shoulders.

Last but not least, an object of the present invention is that of making a garment structure that is easy to make and has good functionality.

These objects and still others, which will become clearer in the course of this description, are substantially reached by a garment structure, as claimed below.

BRIEF DESCRIPTION OF DRAWINGS

Further features and advantages will be clearer from the detailed description of a garment structure, according to the present invention, which is given below with reference to the attached drawings, which are provided for solely illustrative and accordingly non-limiting purposes, in which:

FIGS. 5A and 5B show a first assembly step of the garment structure according to the present invention;

FIGS. 6A and 6B show a second assembly step of the garment structure of FIG. 5.

Figure 1A:
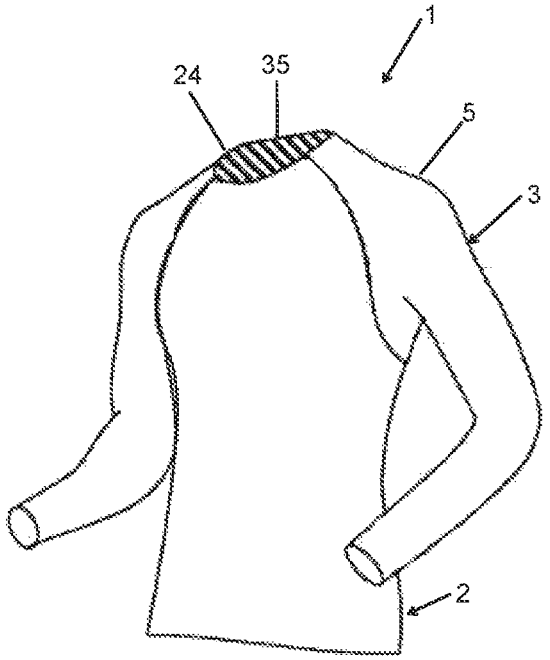
FIGS. 1A and 1B show respectively a front and a rear view of a garment according to the present invention.
Figure 1B:
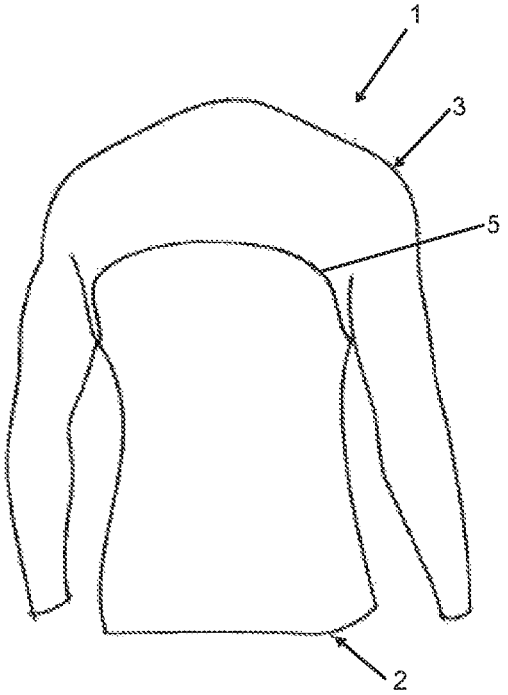

With reference to the cited figures, with 1 a garment has been indicated overall that is made with the structure according to the present invention.

DETAILED DESCRIPTION OF THE INVENTION

The garment in question is a jersey of the base layer or midlayer type for both professional and amateur sporting activities that substantially consist of a front portion, of a rear portion and of sleeves.

According to the present invention, the garment structure 1 in question for making a jersey substantially consists of a first tubular element 2 that corresponds to both the front and rear torso zone and of a second element 3 that is also tubular that affects the arms, the shoulders and part of the torso that are joined together by a single joining line by stitching or by knitting.

More in detail, both the first element 2 and the second element 3 are obtained with circular machines, making a knitted weave that provides for different processes that enable functional and structural features to be given to the knitted fabric and, consequently, to the garment like those illustrated in patent application No. 102017000151111 of the same applicant.

According to this embodiment, the first tubular element 2 has a cylindrical conformation with a lower edge 20 that bounds the length of the jersey and an upper end divided into a pair of profiles: a first rear profile 22 defined, laterally, by the line of the sides with an upper edge 22*a* that is slightly arched but is substantially parallel to the lower edge 20, as shown in FIG. 5B and a second front profile 23 that leads away from the line of the sides continuing the first profile with a trapezium configuration and with a neckline 24 located in the centre, as shown in FIG. 5A. More in detail, the configuration of the second profile 23 has a first portion 23*b* that starts from the line of the side and reaches a recess that defines part of the neckline 24 and a second portion 23*a* that starts from the neckline and reaches the line of the other side.

Figure 4:
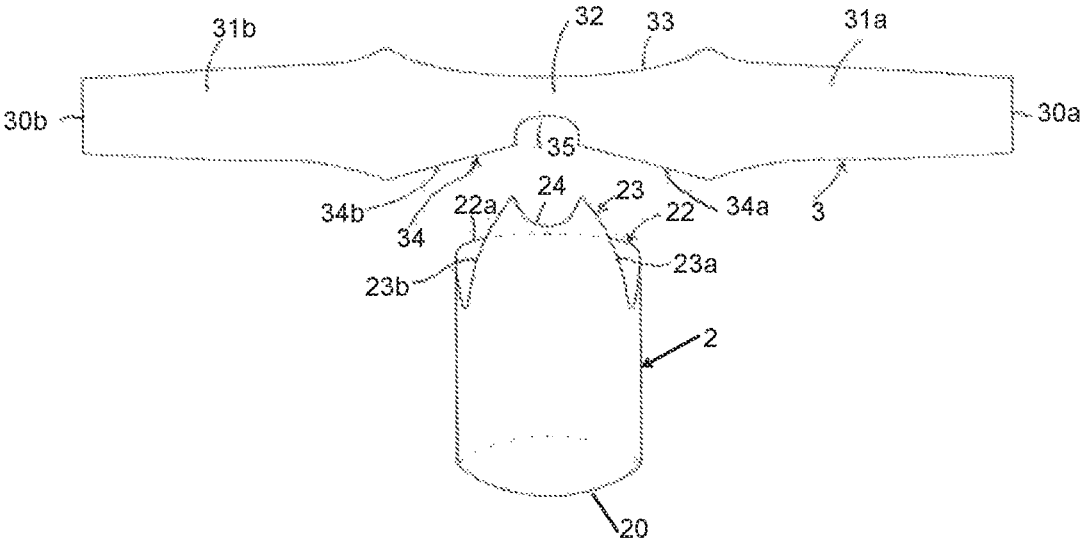
FIG. 4 shows schematically the extent of the garment of FIG. 1.

In particular, the second tubular element 3, shown in the extent thereof, in FIG. 4, has a cylindrical conformation in which each lateral end 30*a* and 30*b* corresponds to a cuff of a sleeve 31*a* and 31*b* that are connected together by a shaped central portion 32.

The shaped portion 32 has in the rear part a contour 33 that is slightly concave to be able to be coupled with the arched edge 22*a* of the first profile 22, as shown in FIG. 6B, whereas in the front part it has a contour 34 configured so that it couples with the trapezium configuration of the front second profile 23 of the first element 2.

In the present embodiment, the contour 34 comprises a first segment 34*b* set up for being joined to the first portion 23*b* and the second segment 34*a* to the second portion 23*a* of the first tubular element 2.

In particular, between the segments 34*b* and 34*a* there is a recess 35 that completes the neckline to form the opening for the passage of the head of the user.

According to the present invention, the shape of the central portion 32 is obtained by cutting the parts that are not necessary from the tubular element, the shape of the central portion 32 being then joined by stitching or knitting the points to the corresponding parts of the first tubular element, as shown in the sequence of images of the FIGS. 5A, 5B, 6A and 6B.

In greater detail and as mentioned, the second tubular element 3, once made, is cut centrally to make the central portion 32, shaped and then folded, as shown in FIG. 5A, until it makes the portions coincide that have to be joined, as shown in FIGS. 6A and 6B.

According to the present invention, in the garment structure in question, in order to join the first element 2 to second element 3, a single stitching line is sufficient.

Figure 2A:
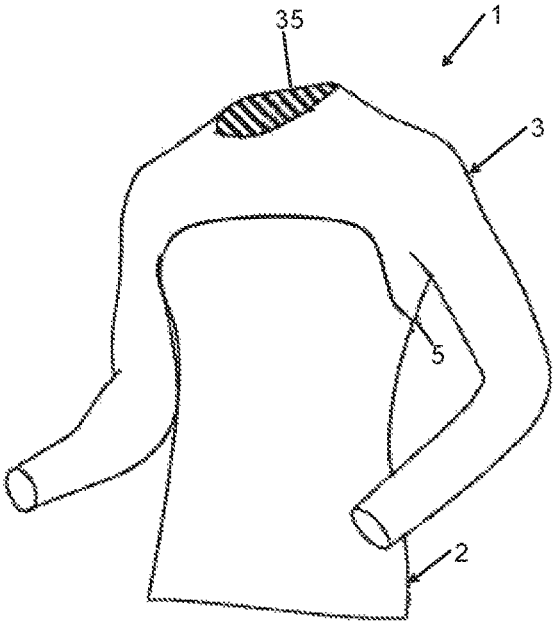
FIGS. 2A and 2B show respectively a front and a rear view of a version of garment of FIG. 1.
Figure 2B:
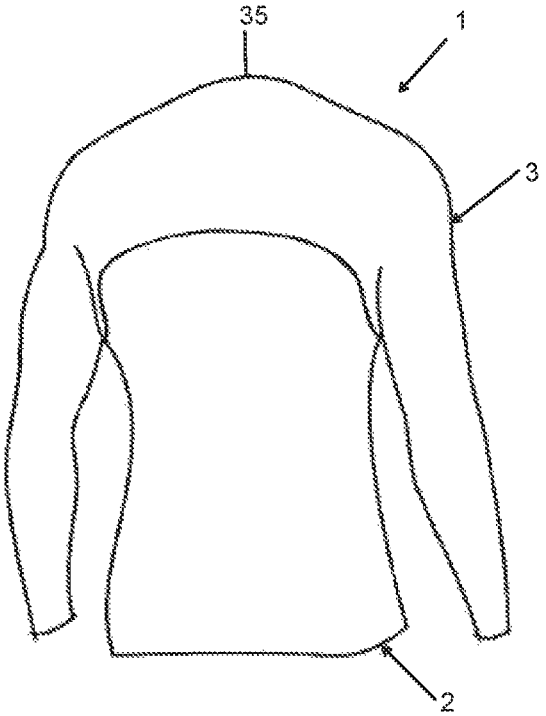

One version of the structure in question provide for the first element always having the upper profile divided into a pair of profiles in which the the first rear profile 22 is the same as the preceding profile and the second front profile 23 has an upper portion 23*a* that is slightly arched and substantially parallel to the lower edge 20 in a manner that is completely similar to the configuration of the rear profile, as shown in FIGS. 2A and 2B. With this configuration, the central portion 32 has an opening 35 for the head of the user. Also with this configuration, a single stitching line 5 is necessary to join the two elements together.

Figure 3A:
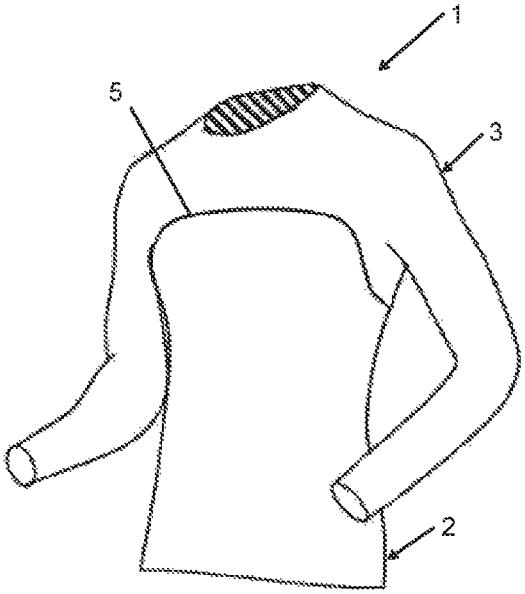
FIGS. 3A and 3B show respectively a front and a rear view of another version of garment made according to the structure in question.
Figure 3B:
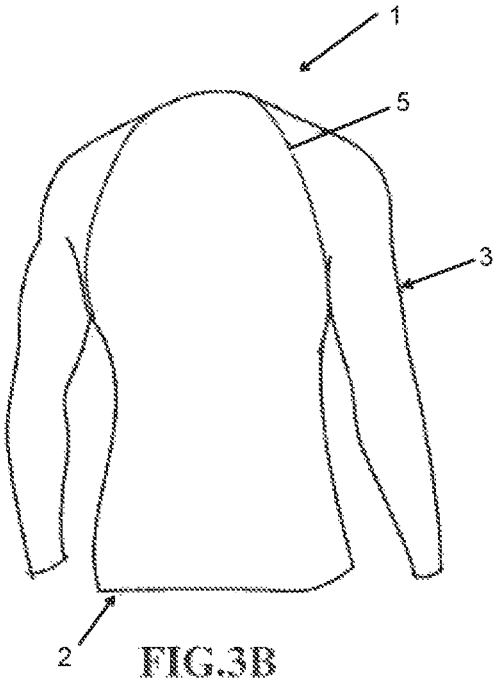

Another version, shown in FIGS. 3A and 3B, provides for the first tubular element 2 having the upper profile divided into a pair of profiles that are exchanged between themselves.

In fact, the first rear profile 22, which is bounded laterally by the line of the sides, has a trapezium configuration and a neckline 24 placed in the centre, as shown in FIG. 3B, whereas the second profile 23 has an upper edge that is slightly arched and practically parallel to the lower edge 20, as shown in FIG. 3A.

Also in this case, a single stitching line is needed to join the two elements 2 and 3.

The garment structure, because of how it is constituted, permits very wide freedom of movement of arms and shoulders that are not limited or constrained by stiffer and less elastic fabric portions under the armpits and/or in the arm hole as occurs in current jerseys because of the presence of stitching in these zones. Further, with this conformation, the sleeve is not longer or shorter depending on the length of the arm of the user, as occurs currently, as having a stitching line present in the arm hole determines and bounds the length of sleeve.

In particular, precisely because of the position of the stitching, the user does not suffer any limitation and/or discomfort in the movements of arms and shoulders in any direction. This enables a sportsperson to manage sporting movements to optimum effect and without constrictions or limitations.

In addition to what has been illustrated so far, the particular conformation of the second element 3 enables a seamless pattern to be obtained over all the part (arms, shoulders and chest), a situation that enables patterns and ornamental embellishments and/or processing to be obtained at the level of seamless weave, which were inconceivable and unachievable with prior art packaging systems.

According to the present invention, the construction of the garment structure in question enables greater and calibrated tension to be given to the rear part of the jersey to improve freedom of movement of shoulders and arms as the tension that the fabric is able to exert is distributed seamlessly and evenly over the entire length of the upper limbs in a single piece that comprises the shoulders and also the upper part of the back. Further, there is no stitching in zones that could cause discomfort like the arm hole.

As has just been illustrated, as seamless and even working can be obtained, using particular, even elastic or elasticized, yarns and weaves over the entire surface of the tubular element or on preset sectors, it is possible to obtain a fabric consistency that contributes to making a user acquire a more supported and thus more correct position of the shoulders and back.

In fact, with the garment structure in question, it is possible to manage at will the support of the shoulders by particular yarns, creating suitable tension zones in the jersey with different elasticity and tensioning permitted by knitting that enables functional features to be obtained through the structure of the knitting. As there is seamless fabric in the upper part of the jersey with the second tubular element as configured, seamless force lines are obtained on the entire part without any interruption due to stitching so that it is possible to intensify, graduate and distribute the said seamless fabric at will and on the basis of need without being forced to circumscribe the seamless fabric to limited jersey sections. In addition, as disclosed for the rear part, the construction of the structure enables also the front part to be tensioned so that the garment is able to assist for example cyclists to maintain a closed and compact position on the chest: this position enables them to be more aerodynamic. In this manner, the structure of the jersey and the tension of the fabric provides help in adopting and maintaining this position with smaller effort.

As mentioned previously, in order to be able to meet different needs, different processing has been obtained in preset zones that enables the desired functional characteristics to be given through construction of the knitted fabric.

In fact, the combination of the yarn, of the thicknesses, and the choice of the formation of the jersey lead to the result on the basis of the structure that is going to be constructed with the yarn so that the previous setting of the knitting process leads to an organized fabric being obtained that encourages breathability and heat regulation and the expulsion of sweat through a thick or more open weave to obtain insulation and protection or with preset tensioning of the jersey that contribute to make the user adopt a correct position.

In fact, in any sport, there is a tendency to train movements specific to that sport, so that it is the only system for obtaining the best sporting performance.

Performing the movement specific to a sport is not only the result of the muscle contraction of a given muscle mass but is the set of several muscular kinetic chains in sequence.

Any imbalance or stress inside this chain affects both the expressed muscular force and the duration of the performance.

In order to be able to have this base condition, it is necessary to have a series of muscular preactivations that orientate and stabilize the bone levers during the entire duration of the movement.

With the garment structure as configured together with the conformation of the fabric it has been seen how this structure is set up mechanically and promotes correct alignment and benefits the sportsperson by assisting the sportsperson by setting up the sportsperson to be in the position that is suitable for the performance by reducing the effort and increasing resistance. In fact, during the execution of a sport movement, the various muscular, capsular and tendon structures send information to the brain in real time on the power, tension and position in space of various bone segments and thus the possibility of the structure and fabric of the garment to give a stimulation to the posture that performs a propioceptive action is as fundamental as the necessity of having a good muscular strength reserve.

If this type of facilitation then follows the natural orientation of the muscle mass and does not limit the muscle mass because the structure is devoid of constraining elements (stitching), both the sensory function and the sliding of the muscle mass under the garment improve.

If they improve, the same movement is performed more correctly and with less effort so that performance is better and there is less expenditure of energy and greater endurance.

Lastly, the possibility of having free movement reduces friction for the professional arising from repeated overload and can reduce the occurrence of traumas in amateurs, who are often not careful about precautions such as, for example, warming up.

After what has been disclosed in a prevalently structural sense, the operation of the invention in question is as follows.

When a user intends to engage in sporting activities in which a series of repetitive movements are performed and which require effort, the user need only wear a garment according to the present invention that is specific to the type of sporting activity to have unlimited freedom of movement, a sense of comfort and wellbeing in the movements, but also correct and suitable heat regulation and consequently good transpiration that ensures a pleasant sensation on the skin.

Further, the garment enables the user to be protected in the various movements and efforts, to be protected in the zones that are potentially exposed to blows and to always have a dry fabric in contact with the skin. In addition, the user does not have feelings of constriction or limitation in movements of both the arms and shoulders, the user does not have discomfort under the armpits or in the arm hole because there is no stitching in those zones, in addition to there being calibrated elasticity for the different parts of the body with greater wearability and support.

The present invention thus achieves the proposed objects.

The garment structure in questions guarantees to the user the greatest freedom of movement without any sensation of constriction or limitation with excellent comfort when worn.

Advantageously, the structure of the garment and the process that make the fabric of the garment enable structural features to be assigned to the garment that are translated into functional features in order to be able to eliminate the discomfort and limitations imposed by the stitching on the movement of arms and shoulders.

Further, the garment structure enables a seamless graphic design and/or to working to be obtained on the entire zone of the shoulders and sleeves, a situation that enables aesthetic configurations to be created that were inconceivable with the construction of prior-art jerseys, the configurations having, in particular, seamless force lines over the entire part without interruptions due to stitching.

Another advantage highlighted with the garment structure according to the present invention is the possibility of being able to manage and calibrate a support for the shoulders that offers assistance and a support for a natural posture and facilitation in adopting a given posture when support is in the front part of the chest.

Further, the garment structure enables a garment to be created that becomes a second skin by adapting to the physiological features and the morphology of the body of the user, offering optimum comfort, a sensation of wellbeing when worn and unlimited freedom of movement without forgetting excellent breathability, good adhesion at the muscle level and protection of parts of the body that are potentially subject to problems.

Advantageously, the garment obtained with the present structure is very light and thin so that it does not take up space when it is used as both a base layer and as a midlayer, leaving optimum freedom of movement to the person wearing the garment.

One advantage obtained with this garment is that of enabling user performance to be promoted and assisted inasmuch as disturbing and uncomfortable elements and the sensation of limitation and constriction from the stitching, are eliminated.

In addition, another aspect of the garment structure arises from the fact that reducing the stitching results in lower garment finishing costs with a reduction in the work steps that has a great impact on production costs and reduces the number of machines with resulting energy savings. In particular, reducing stitching in garments enables production to be obtained that is immediately ready with faster sampling that enables the public to be offered a wider choice and personalization of the garments that is not easily achievable with prior art structures.

A further advantage is due to the fact that the garment structure in question is simple to make and has good functionality.

Naturally, numerous modifications to and variations on this invention can be made that all fall within the scope of the inventive concept that characterizes the invention.

The invention claimed is:

1. A garment structure being used as a base layer or midlayer jersey for sporting activities, the garment structure comprising:

a first tubular element that has a front zone and a rear zone of a torso of the garment structure, the first tubular element having a cylindrical conformation with a lower edge that bounds a length of the garment structure; and a second tubular element configured to be worn on shoulders, arms and an upper part of a torso of a wearer, the first tubular element and the second tubular element being formed of a knitted fabric made by circular knitting machines, wherein the first tubular element has an upper end having two sides, the upper end being divided into a first profile defined, laterally, by a line of the two sides and an upper edge of the upper end of the first tubular element, the upper edge being arched but parallel to the lower edge, and a second profile that leads away from the line of the two sides continuing the first profile with a trapezium configuration and with a neckline located in a center of the trapezium configuration, wherein the second tubular element has a cylindrical conformation and is formed of a single, seamless piece of the knitted fabric, and includes a torso region configured to be worn on the upper part of the torso of the wearer, two intermediate shoulder regions respectively provided at opposite lateral ends of the torso region, and two sleeves, each sleeve extending from a proximal end to a distal end, each sleeve having a cuff at the distal end and an arm hole opening at the proximal end, the proximal end of each sleeve adjoining a respective one of the intermediate shoulder regions such that the torso region is spaced apart from the sleeves by the intermediate shoulder regions, wherein the first tubular element is joined to the second tubular element by a single joining line of stitching or knitting, and wherein the single joining line is formed continuously along all edges of the first and second profiles of the first tubular element and all lower edges of the torso region and the intermediate shoulder regions of the second tubular element, wherein all the lower edges of the torso region and the intermediate shoulder regions of the second tubular element are positioned above a vertical midpoint of the garment structure when the garment structure is in an upright configuration, and wherein the garment structure is configured such that the single joining line does not extend to the respective arm hole openings such that the single joining line is spaced away from the two sleeves.

2. The garment structure according to claim 1, wherein the torso region of the second tubular element has on one side a concave first contour configured to be coupled with the upper edge of the first profile, and on another side the torso region of the second tubular element has a second contour configured to be coupled with the trapezium configuration of the second profile of the first tubular element.

3. The garment structure according to claim 2, wherein the second contour comprises a first segment configured to be joined to a first portion of the first tubular element and a second segment configured to be joined to a second portion of the first tubular element, and between the first and second segments there is a recess that completes the neckline to form an opening for the passage of a head of the wearer.

4. The garment structure according to claim 1, wherein the second profile has a first portion that extends from a line of one of the two sides to a recess that defines part of the neckline, and a second portion that extends from the neckline to a line of the other of the two sides.

5. The garment structure according to claim 4, wherein the torso region of the second tubular element has a contour configured to be coupled with the trapezium configuration of the second profile of the first tubular element, and wherein the contour comprises a first segment configured to be joined to the first portion and a second segment configured to be joined to the second portion, and between the first and second segments there is a recess that completes the neckline to form an opening for the passage of a head of the wearer.

6. The garment structure according to claim 1, wherein the shape of the torso region and the intermediate shoulder regions of the second tubular element is configured to be obtained by cutting out from the second tubular element excess parts, and then the torso region and the intermediate shoulder regions of the second tubular element are folded until the lower edges of the torso region and the intermediate shoulder regions of the second tubular element are aligned with corresponding parts of the edges of the first and second profiles of the first tubular element.

7. The garment structure according to claim 1, wherein the first profile is located at a rear of the first tubular element and the second profile is located at a front of the first tubular element.

8. The garment structure according to claim 1, wherein the first profile is located at a front of the first tubular element and the second profile is located at a rear of the first tubular element.

9. The garment structure according to claim 1, wherein the knitted fabric forming the front zone and the rear zone of the first tubular element greater tension than the knitted fabric forming the second tubular element so as to improve freedom of movement of the shoulders and arms of the wearer, as tension that the knitted fabric forming the second tubular element is able to exert is distributed seamlessly and evenly over the entire length of upper limbs of the wearer in a single piece when the second tubular element of the garment structure is worn on the arms, the shoulders and the upper part of the torso of the wearer.

10. The garment structure according to claim 1, wherein the garment structure includes yarns which are configured to create tension zones in the garment structure with different elasticities and tensioning through the knitting so that seamless force lines are obtained in the entire second tubular element without any interruption due to stitching.

11. A garment structure being used as a base layer or midlayer jersey for sporting activities, the garment structure comprising:

a first tubular element that has a front zone and a rear zone of a torso of the garment structure, the first tubular element having a cylindrical conformation with a lower edge that bounds a length of the garment structure; and a second tubular element configured to be worn on shoulders, arms and an upper part of a torso of a wearer, the first tubular element and the second tubular element being formed of a knitted fabric made by circular knitting machines, wherein the first tubular element has an upper end having two sides, the upper end being divided into a front profile defined, laterally, by a line of the two sides and an upper edge of an upper end of the front profile, the upper edge of the upper end of the front profile being arched but parallel to the lower edge, and a rear profile defined, laterally, by the line of the two sides and an upper edge of an upper end of the rear profile, the upper edge of the upper end of the rear profile being arched but parallel to the lower edge, wherein the second tubular element has a cylindrical conformation and is formed of a single, seamless piece of the knitted fabric, and includes a torso region configured to be worn on the upper part of the torso of the wearer, two intermediate shoulder regions respectively provided at opposite lateral ends of the torso region, and two sleeves, each sleeve extending from a proximal end to a distal end, each sleeve having a cuff at the distal end and an arm hole opening at the proximal end, the proximal end of each sleeve adjoining a respective one of the intermediate shoulder regions such that the torso region is spaced apart from the sleeves by the intermediate shoulder regions, wherein the torso region has an opening for the passage of a head of the wearer, wherein the first tubular element is joined to the second tubular element by a single joining line of stitching or knitting, and wherein the single joining line is formed continuously along all edges of the front and rear profiles of the first tubular element and all lower edges of the torso region and the intermediate shoulder regions of the second tubular element, wherein all the lower edges of the torso region and the intermediate shoulder regions of the second tubular element are positioned above a vertical midpoint of the garment structure when the garment structure is in an upright configuration, and wherein the garment structure is configured such that the single joining line does not extend to the respective arm hole openings such that the single joining line is spaced away from the two sleeves.

* * * * *